US007909150B2

(12) United States Patent
Mangano

(10) Patent No.: US 7,909,150 B2
(45) Date of Patent: Mar. 22, 2011

(54) EXPANDABLE BAG

(75) Inventor: Joy Mangano, St. James, NY (US)

(73) Assignee: Ingenious Designs LLC, Ronkonkoma, NY (US)

( * ) Notice: Subject to any disclaimer, the term of this patent is extended or adjusted under 35 U.S.C. 154(b) by 1138 days.

(21) Appl. No.: 11/584,323

(22) Filed: Oct. 20, 2006

(65) Prior Publication Data

US 2007/0158005 A1 Jul. 12, 2007

Related U.S. Application Data

(63) Continuation-in-part of application No. 11/009,600, filed on Dec. 10, 2004, now Pat. No. 7,178,567.

(51) Int. Cl.
*A45C 7/00* (2006.01)
*A45C 13/10* (2006.01)
*A45C 13/28* (2006.01)

(52) U.S. Cl. ..... 190/103; 190/105; 190/107; 150/103; 393/2

(58) Field of Classification Search ..... 190/103–105, 190/107; 150/103, 107; 282/2; 383/2; 220/6–8
See application file for complete search history.

(56) References Cited

U.S. PATENT DOCUMENTS

| | | | | | |
|---|---|---|---|---|---|
| 600,889 | A | * | 3/1898 | Reitzenbaum | 190/121 |
| 1,045,390 | A | * | 11/1912 | Goldsmith | 190/103 |
| 1,810,347 | A | * | 6/1931 | Daitch | 383/2 |
| 2,030,360 | A | * | 2/1936 | Dyer | 190/117 |
| 2,454,013 | A | | 11/1948 | Scherzinger | |
| 2,672,903 | A | | 3/1954 | Machinist | |
| 2,729,257 | A | | 1/1956 | Keeper | |
| 3,229,741 | A | * | 1/1966 | Ambrose | 383/2 |
| 3,746,066 | A | | 7/1973 | McIntyre | |
| 3,838,758 | A | * | 10/1974 | Brown | 383/38 |
| 4,062,392 | A | * | 12/1977 | Ishii | 383/2 |
| 4,148,347 | A | | 4/1979 | Seaman | |
| 4,153,146 | A | * | 5/1979 | Patton et al. | 190/103 |
| D286,229 | S | * | 10/1986 | Knoepke et al. | D3/286 |
| 4,756,394 | A | | 7/1988 | Cohen | |
| 4,856,570 | A | * | 8/1989 | Rushing et al. | 150/107 |
| 5,038,842 | A | | 8/1991 | Huang | |
| 5,664,652 | A | | 9/1997 | Shamah | |
| 5,765,691 | A | * | 6/1998 | Hall | 206/579 |
| 6,640,856 | B1 | * | 11/2003 | Tucker | 150/130 |
| 7,178,567 | B2 | * | 2/2007 | Mangano | 150/103 |
| 2001/0031104 | A1 | * | 10/2001 | Vazquez | 383/2 |
| 2003/0000612 | A1 | * | 1/2003 | Sutton | 150/105 |
| 2006/0090976 | A1 | * | 5/2006 | Repke et al. | 190/110 |

FOREIGN PATENT DOCUMENTS

FR 2605503 A1 * 4/1988

* cited by examiner

*Primary Examiner* — Sue A Weaver
(74) *Attorney, Agent, or Firm* — Galgano & Associates, PLLC; Thomas M. Galgano; Jessica G. Bower

(57) ABSTRACT

An expandable bag includes a body having a lower portion defining a closed bottom and a generally upstanding lower sidewall having an upper rim and an upper portion defining an upper sidewall having a lower edge coupled adjacent to the upper rim of the lower portion and having an upper rim defining a top opening. The upper portion is movable between a folded position, in which the upper sidewall is folded within the lower sidewall such that the upper rim of the upper portion and the top opening thereof is disposed generally adjacent to the upper edge of the lower portion to define an interior compartment of a certain size, and an extended position, in which the upper portion is unfolded and extended upwardly, thereby extending the height of the body and creating an interior compartment of greater size.

18 Claims, 6 Drawing Sheets

EXPANDABLE BAG

CROSS-REFERENCE TO RELATED APPLICATION

This application is a continuation-in-part of Ser. No. 11/009,600, filed Dec. 10, 2004, now issued U.S. Pat. No. 7,178,567, the contents of which are hereby incorporated herein by reference.

BACKGROUND OF THE INVENTION

1. Field of the Invention

This invention relates broadly to luggage. More particularly, this invention relates to a hand bag which is vertically expandable.

2. State of the Art

Frequently during shopping or traveling it is discovered that a carrying bag is not large enough to accommodate the additional items accumulated during the trip. The prior art discloses many different kinds of expanding bags which address this problem. However, all of these bags are cumbersome and/or aesthetically displeasing.

My previously incorporated parent application discloses an expandable shoulder bag comprising a body having a relatively rigid, lower portion defining a closed bottom and a generally upstanding lower sidewall having an upper rim defining an upper opening and a relatively flexible upper portion defining an upper sidewall having a lower edge coupled adjacent to said upper edge of said lower portion and having an upper rim defining a top opening, said upper portion being movable between a folded position, in which said upper sidewall is folded within said lower sidewall such that said upper rim of said upper portion and said top opening thereof is disposed generally adjacent to said upper edge of said lower portion, thereby defining an interior compartment of a certain size, and an extended position, in which said upper portion is unfolded and extended upwardly, thereby extending the height of said body and, in turn, said bag creating an interior compartment of a greater size.

A strap for supporting said body is secured to said upper portion generally adjacent to said upper rim thereof and releasable coupling means are also provided for releasably coupling said strap to said lower portion which serves to prevent movement of said upper portion from said folded to said extended position when so coupled and which, upon release thereof, permits extension of said upper portion.

Preferably, said releasable coupling means comprises at least one first member secured to said lower portion and at least one second member secured to said strap which first and second members are releasably coupled to one another. Advantageously, said strap has a pair of opposite ends, said lower portion is composed of at least two side panels joined at their opposite lateral and bottom edges, and said releasable coupling means comprises a pair of first members, each secured at an opposite end of said lower portion arid a pair of second members, each secured generally adjacent to an opposite end of said strap. Desirably, said first member is a releasable clasp and said second member is ring.

Since the development of the expandable bag of the parent application, I have applied the concepts of the parent application to a hand bag and made several improvements which are the subject of this application.

SUMMARY OF THE INVENTION

It is therefore an object of the invention to provide a carrying bag such as a woman's hand bag or tote and, in particular, an expandable hand bag.

It is also an object of the invention to provide an expandable hand bag which is easy to use and aesthetically pleasing.

It is another object of the invention to provide an expandable hand bag which in its unexpanded state appears conventional and is not readily discernable as an expandable bag.

Certain of the foregoing and related objects are readily attained according to the present invention by the provision of an expandable bag comprising: a body having a lower main portion having a closed bottom and a pair of generally upstanding, lower opposing sidewalls defining an upper rim and an upper secondary portion having a pair of opposing sidewalls, each having a lower edge coupled to said lower main portion generally adjacent to said upper rim of said lower main portion and having an upper rim defining a top opening, said upper secondary portion being movable between a folded position, in which said sidewalls thereof are folded within said lower sidewalls such that said upper rim of said upper portion and said top opening thereof are disposed generally adjacent to said upper rim of said lower portion, thereby defining an interior compartment of a certain size, and an extended position, in which said upper portion is unfolded and extended upwardly, thereby extending the height of said body and, in turn, said bag, creating an interior compartment of a greater size; a pair of handles, each coupled to an opposite side of said upper portion; and means for releasably coupling said handles to said lower main portion which serves to prevent movement of said upper secondary portion from said folded to said extended position when so coupled and which, upon release thereof, permits upward extension of said upper secondary portion.

Preferably, said means for releasably coupling comprises at least one spring-clip coupled to said lower main portion and at least one first ring coupled to said upper secondary portion adjacent to said upper rim thereof. Said means for releasably coupling may include a second ring coupled to said upper secondary portion but spaced below said at least one first ring. Desirably, at least four spring-clips, four first rings and four second rings are provided.

In a preferred embodiment; the handles each have a pair of opposite ends which are each joined to one of said first rings and said opposite ends of said handles each have a closed loop through which one of said first rings passes. Advantageously, said rim of said upper portion is provided with four pairs of closed loops through each pair of which one of said first rings passes.

Most advantageously, a zipper with two sliders is coupled to said upper rim of said upper portion for opening and closing said top opening thereof. Most desirably, the bag additionally includes means for magnetically coupling said upper secondary portion to said lower main portion. The means for magnetically coupling preferably includes at least one magnetic snap on said lower main portion and at least one magnetic snap on said upper secondary portion. The lower portion is also desirably provided with four vertical reinforcing belts, and each of said spring clips is coupled to one of said belts. Advantageously, each belt has an outstanding loop to which one of said spring clips is coupled. Most desirably, said upper portion has four rings coupled to said upper sidewall closer to said lower edge thereof than said top opening, said four rings of said upper portion being engagable by said four spring clips when said upper portion is in said extended position.

Certain of the foregoing and related objects are also attained according to the present invention by the provision of an expandable bag comprising: an outer portion having a side wall defining a top and a bottom, said bottom being closed; a flexible inner portion having a side wall defining a top and a bottom, said bottom of said inner portion being coupled to said top of said bottom portion and said top of said inner portion defining an opening to said bag; said flexible inner portion being movable from a first position wherein it is substantially contained within said outer portion to a second extended position wherein it is substantially out of said lower portion and located above said outer portion; and first releasable coupling means for releasably coupling said outer and inner portions to each other when said inner portion is in said first position, said first releasable coupling means including a magnetic snap.

Preferably, said first releasable coupling means includes two magnetic snaps, each at an opposite end of said bag. Advantageously, one magnetic snap is located on said outer portion and the other of said magnetic snap located on said inner portion.

Desirably, a second releasable coupling means is provided for releasably coupling said outer and inner portions to each other when said inner portion is in said first position, said second releasable coupling means including a first ring and a spring clip. Advantageously, said ring is coupled to said inner portion and said spring clip is coupled to said outer portion. Most advantageously, third releasable coupling means are provided for releasably coupling said outer and inner portions to each other when said inner portion is in said second position, said third releasable coupling means including a second ring and said spring clip. Desirably, said second ring is vertically spaced apart from said first ring. Advantageously, said first and second rings are coupled to said inner portion and said spring clip is coupled to said outer portion.

Certain of the foregoing and related objects are readily attained according to the present invention by the provision of an expandable hand bag comprising a body having a relatively rigid, lower portion defining a closed bottom and a generally upstanding lower sidewall having an upper rim and a relatively flexible upper portion defining an upper sidewall having a lower edge coupled adjacent to said upper rim of said lower portion and having an upper rim defining a top opening, said upper portion being movable between a folded position, in which said upper sidewall is folded within said lower sidewall such that said upper rim of said upper portion and said top opening thereof is disposed generally adjacent to said upper rim of said lower portion, thereby defining an interior compartment of a certain size, and an extended position, in which said upper portion is unfolded and extended upwardly, thereby extending the height of said body and, in turn, said bag creating an interior compartment of a greater size.

A pair of hand grips are secured to opposite sides of said upper portion generally adjacent to said upper rim thereof and releasable coupling means are also provided for releasably coupling said hand grips to said lower portion which serves to prevent movement of said upper portion from said folded to said extended position when so coupled and which, upon release thereof, permits extension of said upper portion.

According to a preferred embodiment, the upper portion is provided with four pairs of loops, two pair on one side and two pair on the other side. The hand grips each have two ends which terminate in a loop. The hand grip loops are coupled to the fabric loops via four, preferably metal rings. When in the folded position, the rings are located adjacent to decorative vertical reinforcing straps on the outer surface of the lower portion. Each of the reinforcing straps has an outstanding loop which is coupled to the base portion of a spring clip. Each of the four spring clips is releasably coupled to one of the four rings. When the clips are uncoupled from the rings, the upper portion can be pulled out of the lower portion, thus expanding the volume of the hand bag. Access to the interior of the handbag is preferably controlled by a zipper coupled to the upper rim of the upper portion. The side wall of the upper portion is preferably provided with reinforcing straps which align with the reinforcing straps on the lower portion. The upper portion reinforcing straps each have an outstanding loop which is coupled to a ring which is releasably coupled to one of the spring clips so that the clips do not dangle when the upper portion of the bag is extended.

Looking at the side of the bag with the upper portion folded into the lower portion, the height to width ratio is approximately 2:5 and the vertical extent of the hand grips is slightly more that the height of the bag. With the upper portion extended, the height of the bag is increased by about 65%.

According to a further preferred embodiment, when in the folded position, the upper and lower portions are also secured to each other by interior magnetic snaps on the lower portion which mate with exterior magnetic snaps on the upper portion. In addition, according to a further preferred embodiment, the zipper is provided with two sliders for easier access to the interior of the bag. Furthermore, a decorative tassel is preferably coupled to one of the rings to which the hand grips are attached.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
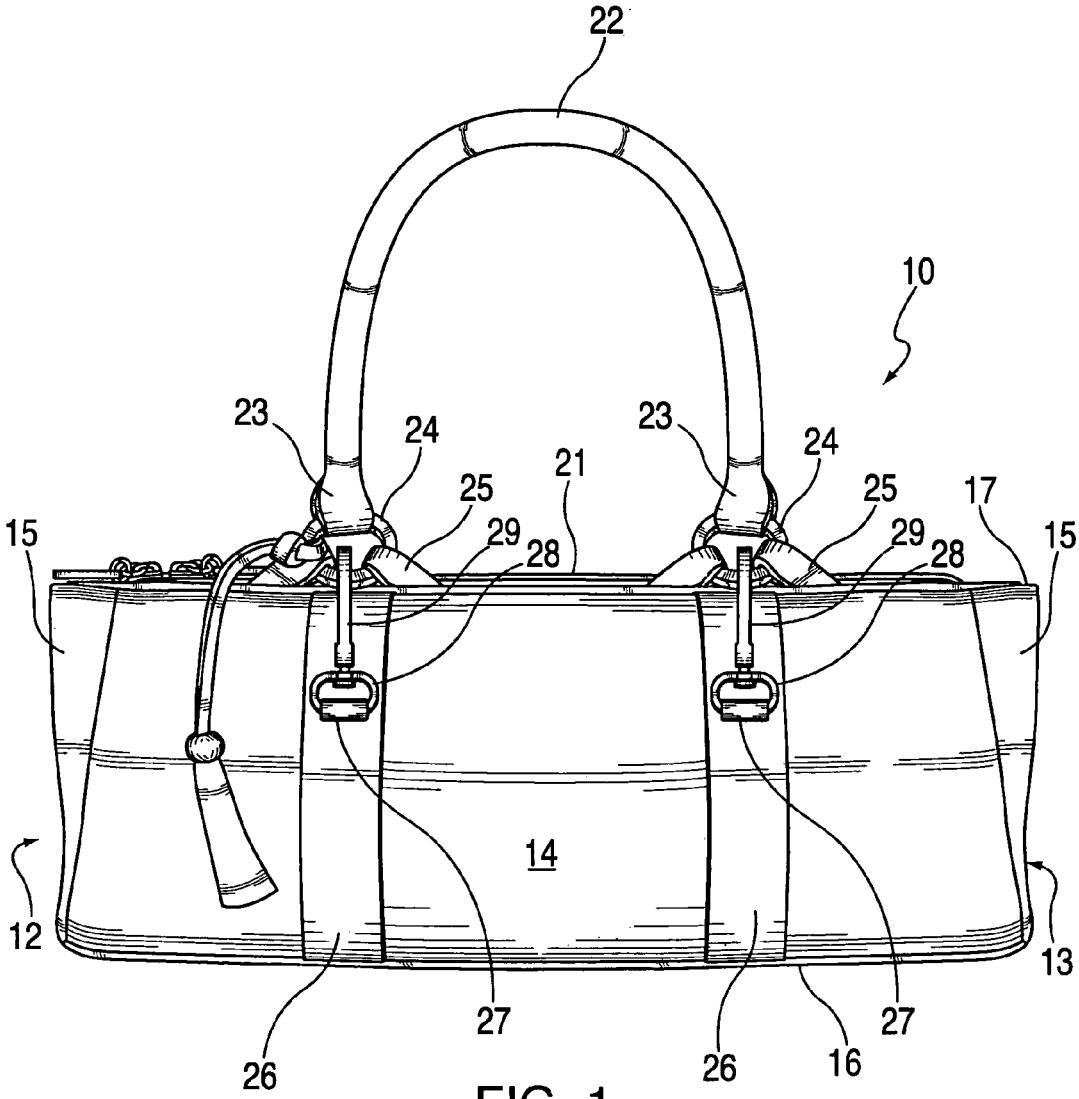
FIG. 1 is a side elevational view of an expandable bag according to the invention in the unexpanded state.
Figure 2:
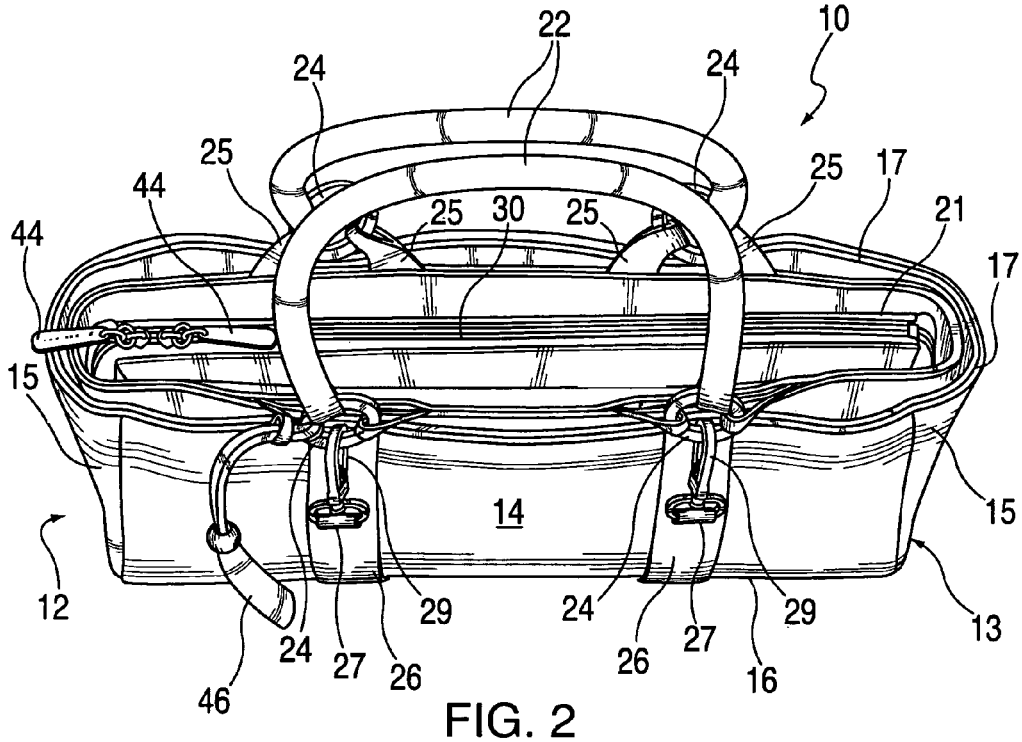
FIG. 2 is a perspective top and side view of an expandable bag according to the invention in the unexpanded state.
Figure 3:
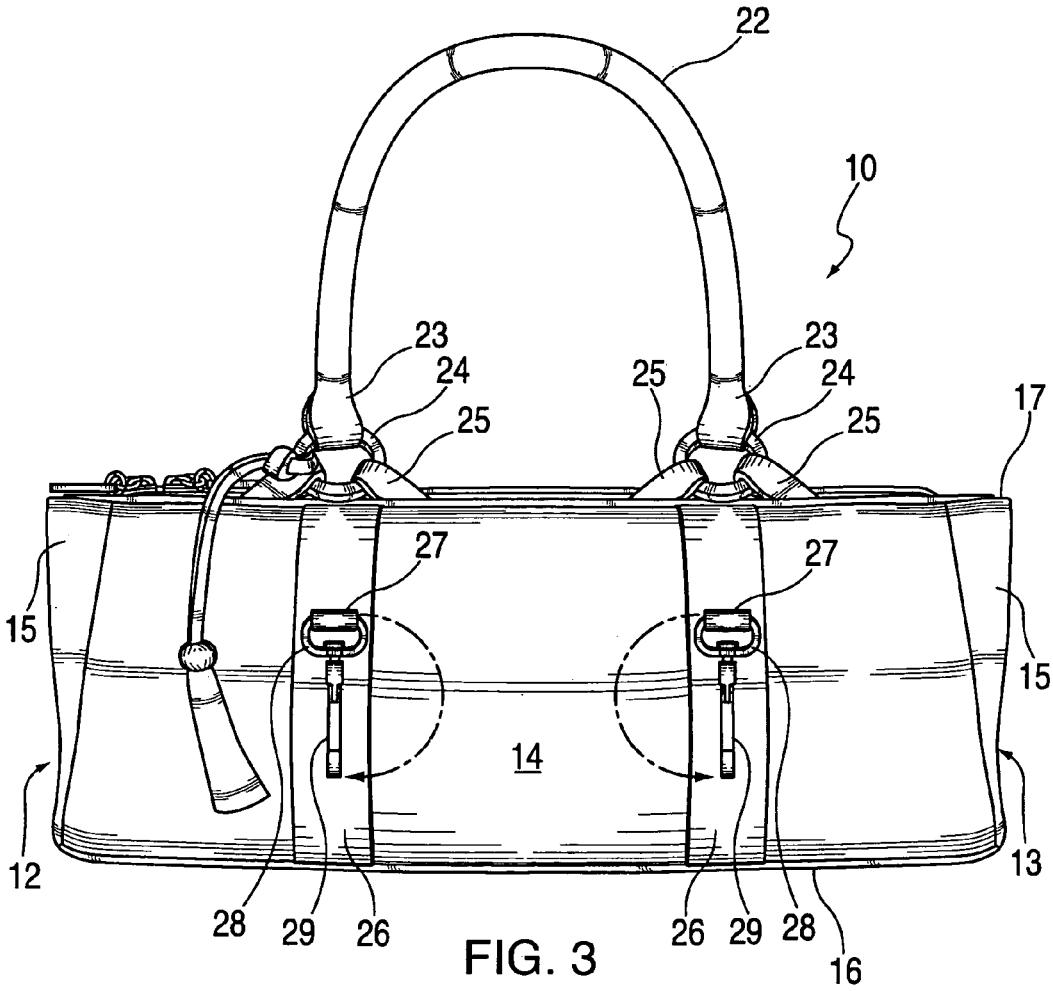
FIG. 3 is a view similar to FIG. 1, but with the spring clips uncoupled from the handle rings in preparation of expanding the bag.

Turning now to the Figures and, in particular FIGS. 1-3, an expandable hand bag 10 according to the invention includes a body 12 having a lower main body portion 13 having two opposing side panels or side walls 14 which are each joined at opposite lateral ends to opposing end panels or end walls 15 and along their bottom edges to a closed bottom panel 16, preferably via stitching. The top edges of the side panels 14 and end panels 15 define an upper open rim 17.

Figure 4:
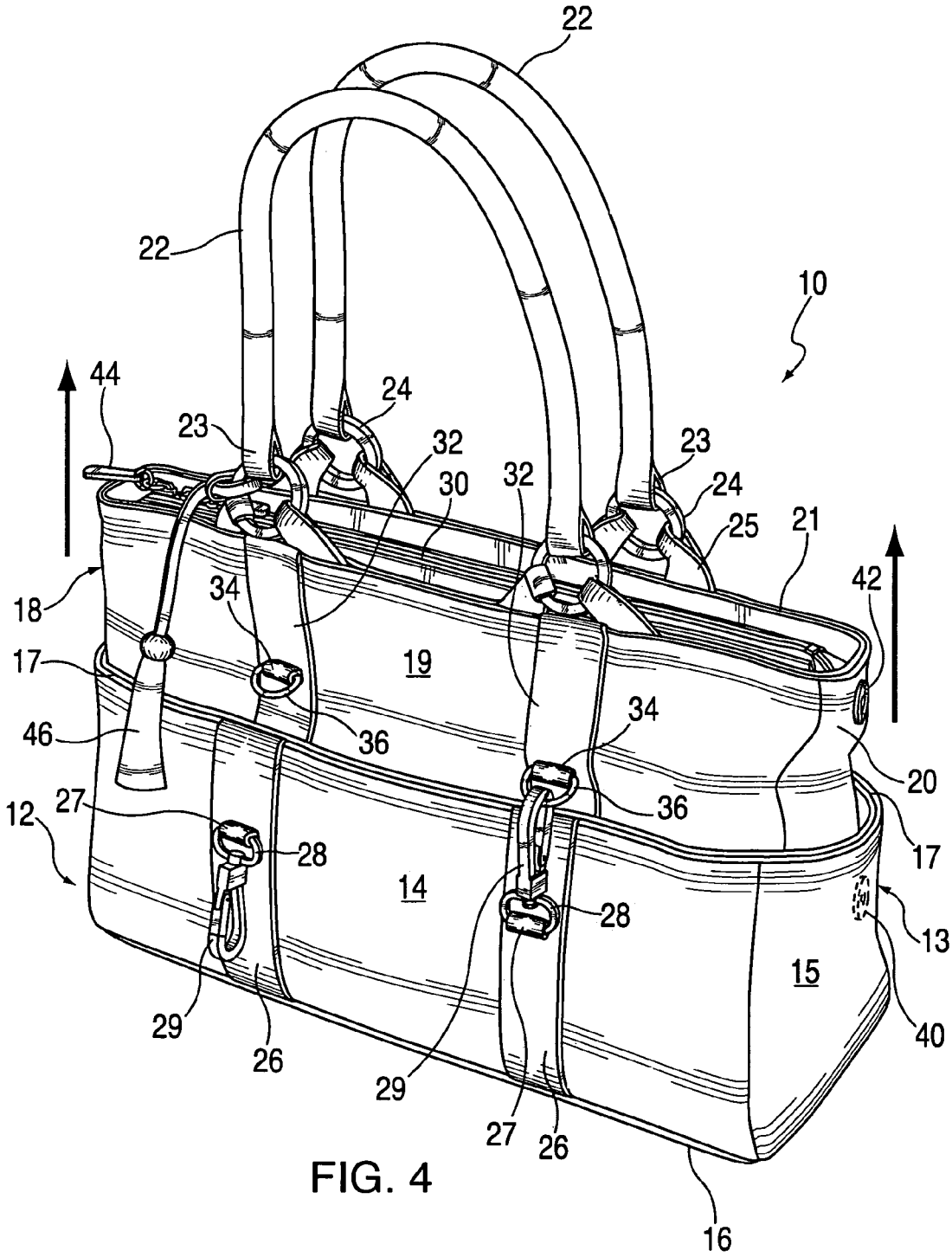
FIG. 4 is a perspective top, side and end view of the expandable bag according to the invention in an expanded state.
Figure 5:
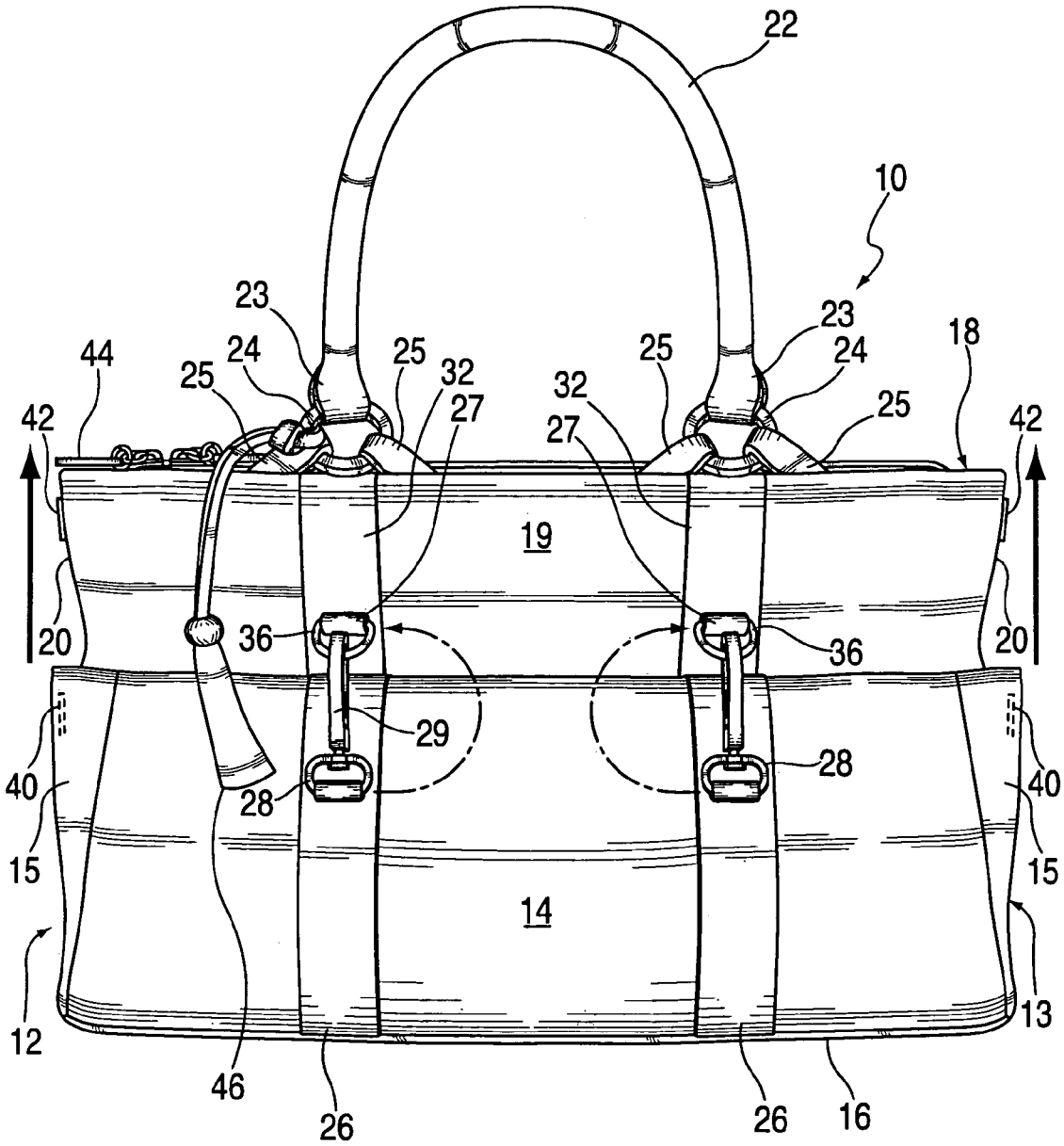
FIG. 5 is a side elevational view of the bag in the expanded state.
Figure 6A:
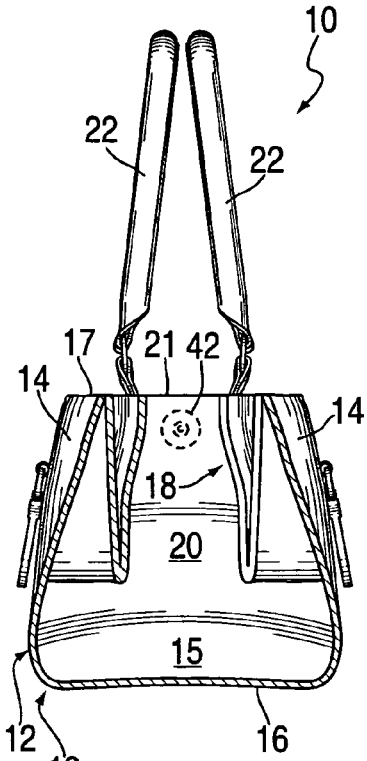
FIGS. 6*a*, 6*b*, and 6*c* are schematic side sectional views showing, respectively, the bag in the unexpanded state, partially expanded state and fully expanded state.
Figure 6B:
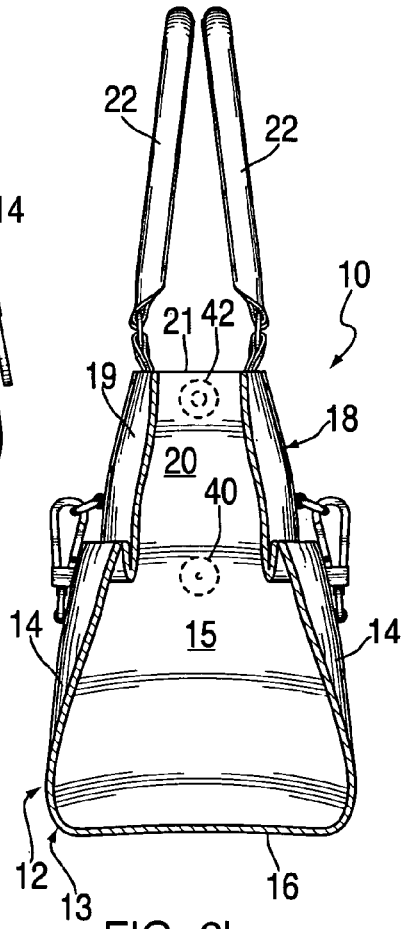
Figure 6C:
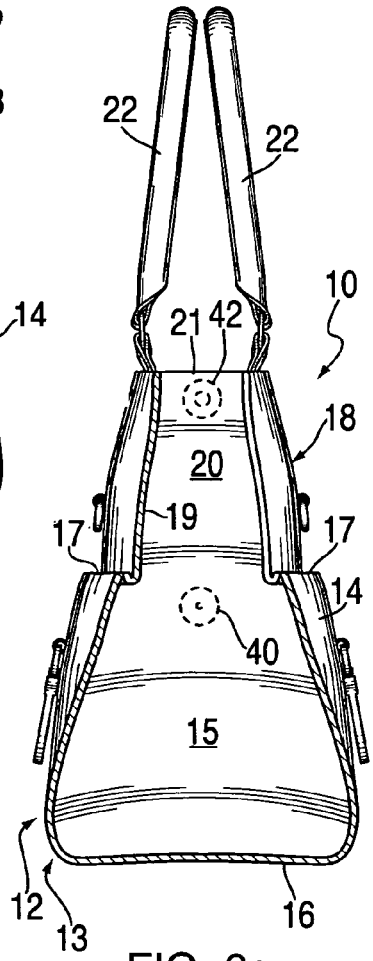

As best seen in FIGS. 4 and 5, an upper secondary body portion 18 is provided having two opposing side panels or side walls 19 which are each joined to opposing end panels or end walls 20. As seen best in FIG. 6*c*, the bottom edges of the side panels 19 and end panels 20 are each coupled via an upturned edge to the interior sides of corresponding side panel 14 and end panel 15, respectively, of the lower main body portion 13, adjacent to but spaced below the upper rim 17 of said lower portion 13 preferably via stitching. The top edges of side panel 19 and end walls 20 cooperatively define an upper rim 21 generally defining a top opening.

The upper portion 18 is movable between a generally hidden folded position (FIGS. 1-3 and 6*c*), in which said upper side walls 19 and end walls 20 are folded within said lower side walls 14 and end walls 15 such that said upper rim 21 of said upper portion 18 and top opening defined thereby is disposed generally adjacent to, and within, the upper rim 17 of said lower portion 13, thereby defining an interior compartment of a certain size, and an extended position or state (FIGS. 4 and 5 and 6*a*), thereby extending the height of said body 12 and creating an interior compartment of a greater size.

A pair of straps or handles 22 (seen best in FIGS. 2 and 4) are each secured to an opposite side panel 19 of said upper portion 18 generally adjacent to said upper rim 21 thereof.

Each strap has a pair of free ends 23 in the form of a loop by which they are attached to an annular metal ring 24. Similarly, four pairs of short straps 25 are coupled to the upper rim 21 and each has a looped end by which each pair is received on the same ring 24 as one of the handle free ends 23.

When in the folded state (FIGS. 1-2), the rings 24 are located adjacent to decorative vertical reinforcing straps 26 (only two of the four can be seen in the drawings) on the outer surface of the lower portion 13. Each of the reinforcing straps has a loop 27 which is coupled pivotably, via a ring 28 to the base portion of a spring clip 29. Each of the four spring clips 29 (only two can be seen in the drawings) is releasably coupled to one of the four rings 24. When the clips 29 are uncoupled from the rings 24 (FIGS. 3 and 4), the upper portion 18 can be pulled out of the lower portion 13, as illustrated in the sequence illustrated in FIGS. 6*a*, 6*b*, and 6*c*, thus expanding the volume of the hand bag 10.

Access to the interior of the handbag 10 is preferably controlled by a zipper 30 (seen best in FIGS. 2 and 4) coupled to the upper rim 21 of the upper portion 18. The side walls 19 (FIGS. 4 and 5) of the upper portion 18 are also preferably provided with reinforcing straps 32 (only two of the four can be seen in FIGS. 4 and 5) which align with the reinforcing straps 26 on the lower portion 13. The upper portion reinforcing straps 32 also each have a loop 34 which pivotably supports a generally D-shaped ring 36 which is releasably coupled to one of the spring clips 29 so as to assist in supporting the upper portion 18 of the bag 10 when in its extended position in proper, general vertical, alignment with the lower portion 13 of the bag 10 and preventing it from collapsing to its folded position (FIGS. 4 and 5).

Comparing the height of the bag with the upper portion 18 folded into the lower portion (FIGS. 1 and 3), and with the upper portion extended (FIGS. 4 and 5), the height of the body 13 is preferably increased by about 50%. Of course, the height can be varied to suit a particular desired volume gain.

According to a particularly preferred embodiment, when in the folded state, the upper and lower portions 18, 13, respectively, are also secured to each other by magnets or magnetic snaps 40 on each of the interior sides of end panels 15 of the lower portion 13 which mate with magnets or magnetic snaps 42 on the exterior sides of end panels 20 of the upper portion 18. (These snaps are actually seen best in FIGS. 4 and 5 though the snaps engage each other when the bag is folded as shown in FIGS. 1-3.)

It will be appreciated that the magnetic snaps 40, 42 also keep the upper end walls 20 of the upper portion 18 secured to the end walls 15 of the lower portion 13 to facilitate opening of the bag when the zipper 30 is pulled. The zipper 30 is provided with two sliders 44 (seen best in FIG. 2). Furthermore, a decorative tassel 46 is coupled to one of the rings to which one of the straps the hand grips are attached. Optionally, in lieu of or in addition to the tassel, a fob bearing a trademark or a monogram (not shown) may be attached to one of the rings.

There have been described and illustrated several embodiments of an expandable hand bag. While particular embodiments of the invention have been described, it is not intended that the invention be limited thereto, as it is intended that the invention be as broad in scope as the art will allow and that the specification be read likewise. For example, although it is particularly advantageous to use the spring clip-ring assemblies and/or magnetic snaps described above, other releasably coupling means, e.g., mechanical snaps, buttons, Velcro fasteners, etc. could possible be employed to suit a particular application. In addition, the handbag can be made of a variety of materials and the relative rigidity of the lower main body portion and the upper main body portion is preferably selected so that the movement thereof between the unexpanded and the expanded states can be accomplished without the aid of an internal, movable support frame, i.e., the bag would preferably be "frameless", (in comparison see, e.g., U.S. Pat. No. 1,060,824). It will therefore be appreciated by those skilled in the art that yet other modifications could be made to the provided invention without deviating from its spirit and scope as claimed.

What is claimed is:

1. An expandable bag comprising:

a body having a lower main portion having a closed bottom and a pair of generally upstanding, opposing lower sidewalls defining an upper rim and an upper secondary portion having a pair of opposing upper sidewalls, each having a lower edge coupled to said lower main portion generally adjacent to said upper rim of said lower main portion and having an upper rim defining a top opening, said upper secondary portion being movable between a folded position, in which said upper sidewalls thereof are folded within said lower sidewalls such that said upper rim of said upper secondary portion and said top opening thereof are disposed generally adjacent to said upper rim of said lower main portion, thereby defining an interior compartment of a certain size, and an extended position, in which said upper portion is unfolded and extended upwardly, thereby extending the height of said body and, in turn, said bag, creating an interior compartment of a greater size;

a pair of handles, each coupled to an opposite sidewall of said upper secondary portion; and means for releasably coupling said handles to said lower main portion which serves to prevent movement of said upper secondary portion from said folded to said extended position when so coupled and which, upon release thereof, permits upward extension of said upper secondary portion wherein said means for releasably coupling said handles comprises four spring clips coupled to said lower main portion, four first rings coupled to said handles generally adjacent to said upper rim of said upper secondary portion, and four second rings coupled to said upper sidewalls of said upper secondary portion, but spaced below said four first rings, wherein said spring clips are each engageable with one of said second rings when said upper secondary portion is in said extended position and said spring clips are each engageable with one of said first rings when said upper portion is in said folded position.

2. The bag according to claim 1, wherein said handles of said pair of handles each have a pair of opposite ends which opposite ends are each joined to one of said four first rings.

3. The bag according to claim 2, wherein:

said four second rings are coupled to said upper sidewall of said upper portion closer to said lower edge thereof than said top opening.

4. The bag according to claim 2, wherein:

said lower main portion is provided with four vertical reinforcing belts, and each of said four spring clips is coupled to one of said belts.

5. The bag according to claim 4, wherein:

each belt has an outstanding loop to which one of said spring clips is coupled.

6. The bag according to claim 2, wherein said opposite ends of said handles each have a closed loop through which one of said first rings passes.

7. The bag according to claim 6, wherein:

said upper rim of said upper secondary portion is provided with four pairs of closed loops through each pair of which, one of said four first rings passes.

8. The bag according to claim 7, further comprising:

a zipper with at least one slider coupled generally adjacent to said upper rim of said upper portion for opening and closing said top opening thereof.

9. The bag according to claim 8, wherein:

said zipper has two sliders coupled to said upper rim of said upper portion for opening and closing said top opening thereof.

10. The bag according to claim 1, additionally including means for magnetically coupling said upper secondary portion to said lower main portion.

11. The bag according to claim 10, wherein said means for magnetically coupling includes at least one magnetic snap on said lower main portion and at least one magnetic snap on said upper secondary portion.

12. An expandable bag comprising:

an outer portion having a side wall defining a top and a bottom and opposite end walls, said bottom being closed;

a flexible inner portion having a side wall defining a top and a bottom and opposite ends, said bottom of said inner portion being coupled to said top of said outer portion and said top of said inner portion defining an upper rim, and, in turn, an opening to said bag, said flexible inner portion being movable from a first position in which it is substantially contained within said outer portion to a second extended position in which it is substantially out of said outer portion and located above said outer portion;

a pair of handles, each coupled to said flexible inner portion;

first releasable coupling means for releasably coupling said outer and inner portions to each other when said inner portion is in said first position, said first releasable coupling means including two pairs of magnetic snaps, each at an opposite end of said bag, wherein one magnetic snap is mounted on one of said end walls of said outer portion and the other of which is mounted opposite thereto on one of said ends of said inner portion; and second releasable coupling means for releasably coupling said outer and inner portions to each other when said inner portion is in said first and second positions, comprising four spring clips coupled to said outer portion, four first rings coupled to said handles generally adjacent to said upper rim of said inner portion, and four second rings coupled to said sidewall of said inner portion, but spaced below said first rings, wherein said spring clips are each engageable with one of said second rings when said inner portion is in said second extended position and, alternatively, said spring clips are each engageable with one of said first rings when said inner portion is in said first position.

13. A bag according to claim 12, wherein:

said four second rings are each vertically spaced directly below one of said four first rings.

14. An expandable bag comprising:

an outer portion having a side wall defining a top and a bottom and opposite end walls, said bottom being closed;

a flexible inner portion having a side wall defining a top and a bottom and opposite ends, said bottom of said inner portion being coupled to said outer portion and said top of said inner portion defining an upper rim, and, in turn, an opening to said bag, said flexible inner portion being movable from a first position in which it is substantially contained within said outer portion to a second extended position in which it at least partially projects out of said outer portion so that said top of said side wall thereof is raised above said outer portion;

a pair of handles, each coupled to said flexible inner portion;

first releasable coupling means for releasably coupling said outer and inner portions to each other when said inner portion is in said first position, said first releasable coupling means including two pairs of magnetic snaps, each at an opposite end of said bag, wherein one magnetic snap is mounted on one of said end walls of said outer portion and the other of which is mounted opposite thereto on one of said ends of said inner portion; and second releasable coupling means for releasably coupling said outer and inner portions to each other when said inner portion is in said first and second positions, comprising four spring clips coupled to said outer portion, four first rings coupled to said handles generally adjacent to said upper rim of said inner portion, and four second rings coupled to said sidewall of said inner portion, but spaced below said first rings, wherein said spring clips are each engagable with one of said second rings when said inner portion is in said second extended position and, alternatively, said spring clips are each engageable with one of said first rings when said inner portion is in said first position.

15. A bag according to claim 14, wherein:

said four second rings are each vertically spaced directly below one of said four first rings.

16. An expandable bag comprising:

a body having a lower main portion having a closed bottom and a pair of opposing lower sidewall portions and an upper secondary portion having a pair of opposing upper sidewall portions coupled to said lower main portion and having an upper rim defining a top opening, said upper secondary portion being movable between a folded position, in which said upper sidewall portions thereof are at least partially folded, thereby defining an interior compartment of a certain size, and an extended position, in which said upper portion is unfolded and extended upwardly, thereby extending the height of said body and, in turn, said bag, creating an interior compartment of a greater size;

a pair of handles, each coupled to an opposite sidewall portion of said upper secondary portion; and means for releasably coupling said handles to said lower main portion which serves to prevent movement of said upper secondary portion from said folded to said extended position when so coupled and which, upon release thereof, permits upward extension of said upper secondary portion, wherein said means for releasably coupling said handles comprises a set of four spring clips and a set of four first rings, wherein one of said set of four spring clips and said set of four first rings is coupled to said handles generally adjacent to said upper rim of said upper secondary portion and the other of said sets is coupled to said lower main portion, and wherein said means for releasably coupling includes a set of four second rings coupled to said upper sidewall portions of said upper secondary portion, but spaced above the other of said set of four first rings and said set of four spring clips, and wherein said spring clips are each engageable with one of said second rings when said upper secondary portion is in said extended position and, alternatively, are each engageable with one of said first rings when said upper secondary portion is in said folded position.

17. The bag according to claim 16, wherein said handles of said pair of handles each have a pair of opposite ends which opposite ends are each joined to one of said four spring clips.

18. The bag according to claim 17, wherein said opposite ends of said handles each have a closed loop through which one of said spring clips passes.

* * * * *